US005741115A

United States Patent [19]

Goglio

[11] Patent Number: 5,741,115

[45] Date of Patent: Apr. 21, 1998

[54] HANDLING SYSTEM FOR FLAT HOLLOW BODIES

[76] Inventor: Luigi Goglio, Via Frua, 11 - 20146 Milano, Italy

[21] Appl. No.: 738,549

[22] Filed: Oct. 28, 1996

[30] Foreign Application Priority Data

Nov. 2, 1995 [IT] Italy ..... MI95A2269

[51] Int. Cl.[6] ..... B65G 59/06

[52] U.S. Cl. ..... 414/797.9; 206/303; 206/493; 206/499

[58] Field of Search ..... 206/493, 303, 206/499, 555, 718; 414/797.9

[56] References Cited

U.S. PATENT DOCUMENTS

| | | | |
|---|---|---|---|
| 2,997,220 | 8/1961 | Williamson | 220/416 |
| 3,759,377 | 9/1973 | Weimer . | |
| 3,872,969 | 3/1975 | Jean | 206/493 X |
| 5,287,965 | 2/1994 | Miller . | |
| 5,467,894 | 11/1995 | Altonen et al. | 206/499 X |
| 5,573,368 | 11/1996 | Freudelsperger | 414/797.9 X |

FOREIGN PATENT DOCUMENTS

| | | |
|---|---|---|
| 0 522 326 | 1/1993 | European Pat. Off. . |
| 766172 | 6/1934 | France . |
| 945558 | 7/1956 | Germany . |
| 948047 | 8/1956 | Germany . |

*Primary Examiner*—Janice L. Krizek

*Attorney, Agent, or Firm*—Burns, Doane, Swecker & Mathis, L.L.P.

[57] ABSTRACT

A system is described for handling flat, hollow bodies, particularly frames destined to feed automatic packaging machines, according to which use is foreseen of hollow tubular cores (2) on which the frames (1) are inserted and retained by liftable tongues (10). The tubular cores (2) complete with frames (1) or loaders/magazines (25) are stored in rows placed one on top of the other inside container boxes (20), and can be used to load a feed unit (30) of a packaging machine, comprising a plurality of hollow columns (A,B,C,D), each forming an inner housing (31), accessible through a corresponding door (32) at the front, for stacking of the frames (1).

17 Claims, 4 Drawing Sheets

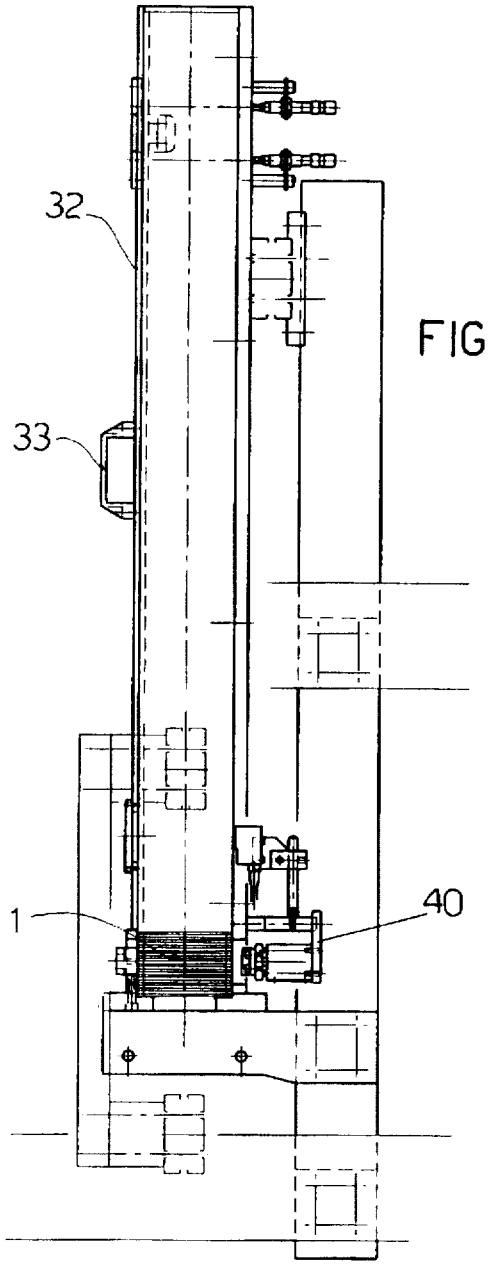
FIG. 12
FIG. 13
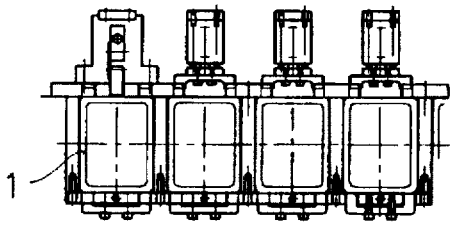
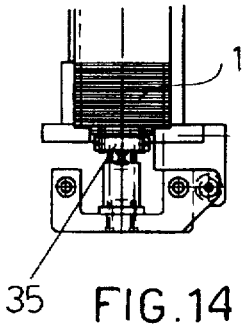
FIG. 14
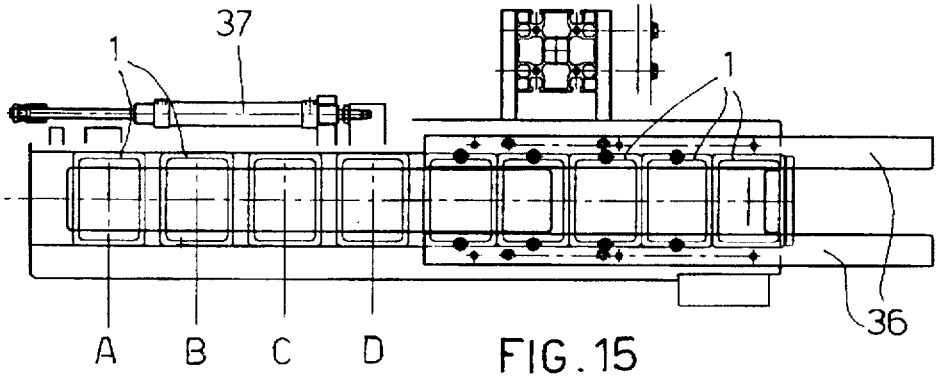
FIG. 15

HANDLING SYSTEM FOR FLAT HOLLOW BODIES

BACKGROUND AND SUMMARY

The present invention relates to a handling system for flat hollow bodies, particularly for frame-shaped frames, used in the packaging sector.

European patent No. 522,326 in the name of the same applicant, Luigi Goglio, describes, for example, a container made of flexible material that takes on a rigid consistency, when a base plate and upper rectangular frame, both made of plastics, are placed inside the flexible sheet material.

At present handling of such flat, hollow, rectangular frames is not carried out rationally, as regards not only storage and transportation but also feeding of said frames to automatic packaging machines.

The frames are normally stored in bulk, with an apparent increase in volume and therefore in transport and handling costs.

Feeding of the frames to automatic machines also takes place haphazardly, for example by means of vibrating systems, which orientate and direct the frames in an orderly line towards the application area in the packaging machine.

This vibrating feed system makes the machine very bulky, especially as regards its width, and is unreliable.

The aim of the invention is to eliminate the above drawbacks, providing a handling system for hollow, flat bodies that is highly reliable and considerably reduces bulk during storage, transport and feeding of the frames to the machine.

This aim is achieved by the handling system for hollow bodies according to the invention.

Essentially, the handling system for hollow bodies according to the invention comprises supporting cores consisting of suitably shaped folding cardboard tubes, on which the frames can be arranged, to be kept in an orderly fashion. The tubes loaded with frames are then collected in suitable boxes, with optimal use of the space.

The frames thus collected are then loaded into the packaging machine in suitable vertical columns, thus forming piles from each of which the frames are taken in sequence starting from the lowest.

BRIEF DESCRIPTION OF THE DRAWINGS

Further characteristics of the invention will be made clearer by the detailed description that follows, referring to a purely exemplary and therefore non-limiting embodiment, illustrated in the appended drawings, in which:

FIG. 12 is a side view, taken from the right side in FIG. 10;

FIG. 13 is a section taken along the line XIII—XIII in FIG. 10;

FIG. 14 is a section taken along the line XIV—XIV in FIG. 10;

FIG. 15 is a plan view of the unit in FIG. 10 taken lower down than that in FIG. 11.

DETAILED DESCRIPTION

In the example shown in the appended figures the flat bodies to be handled consist of rectangular frame-shaped flames, each indicated as a whole with reference number 1.

The dimensions of each frame are b×h, width l and thickness s.

Merely by way of example, for frame 1 the dimensions indicated above can be the following: b=80 mm, h=105 mm, l=5 mm and s=3 mm.

Figure 1:
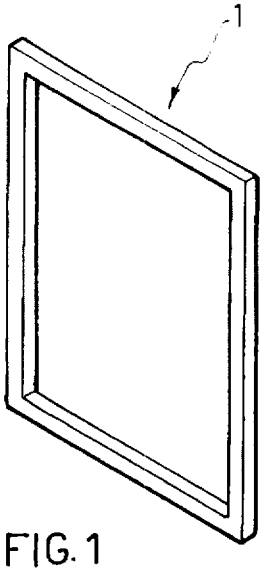
FIG. 1 is an axonometric view of a frame.
Figure 2:
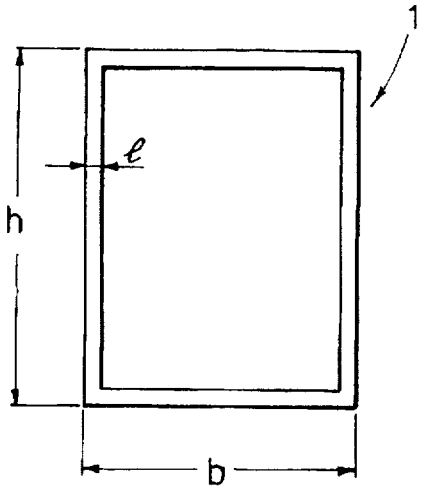
FIG. 2 is a plan view of the frame in FIG. 1.
Figure 2A:
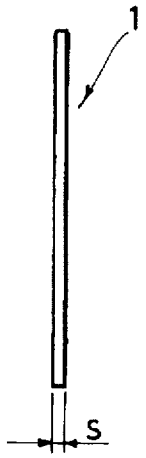
FIG. 2*a* is a side view of said frame.
Figure 3:
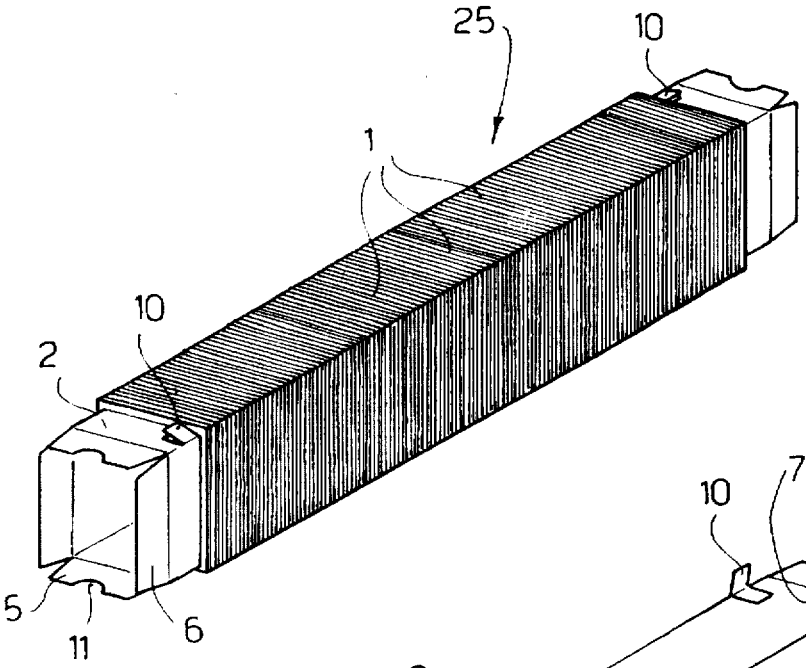
FIG. 3 is an axonometric view showing a tubular cardboard core loaded with a plurality of the frames shown in FIG. 1.

For handling of the frames 1 use is made of special tubular cores of folding cardboard 2, having a prism shape, the cross section of which substantially corresponds to the inner perimeter of the frame 1. A considerable number of frames 1 can thus be slid onto the cardboard tubes 2, as shown in FIG. 3.

Figure 4:
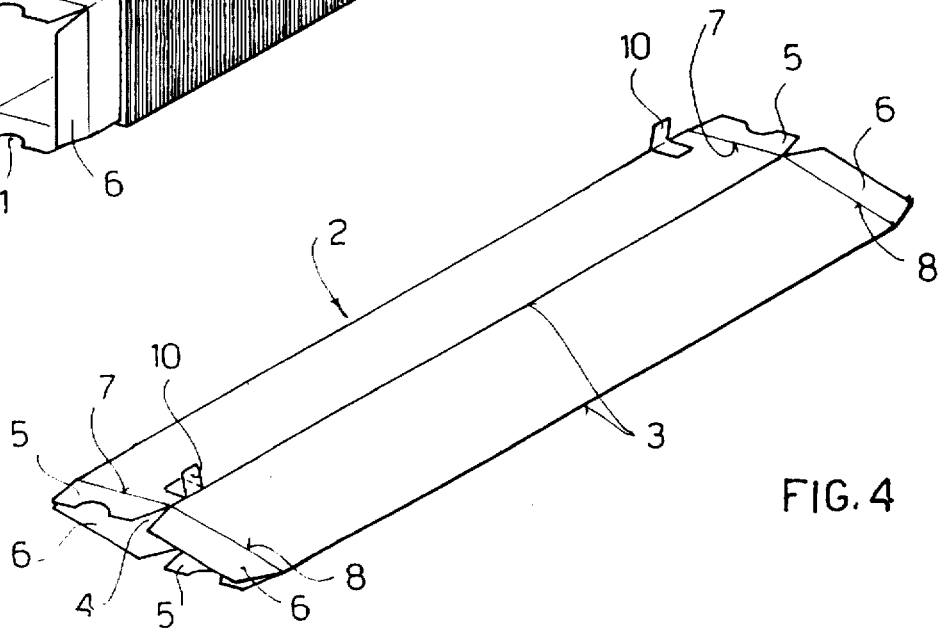
FIG. 4 is an axonometric view of the cardboard tubular core alone, shown in a partially closed position.
Figure 5:
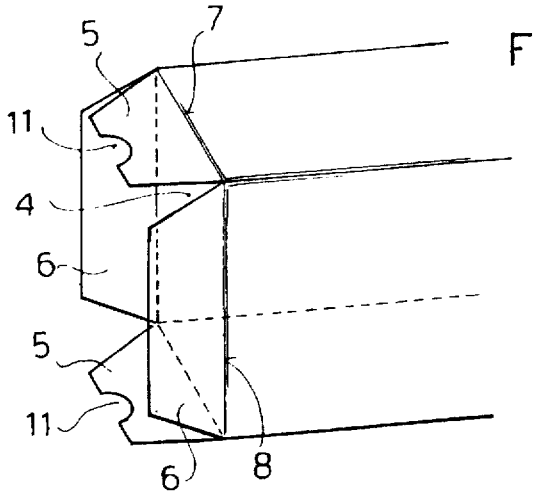
FIG. 5 shows one end of the tubular core in FIG. 4.
Figure 6:
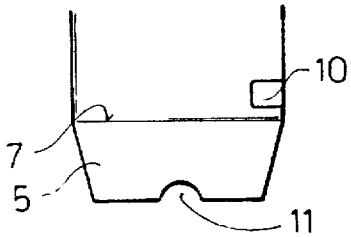
FIGS. 6 and 7 are plan views of two adjacent flaps of the end of the tubular core shown in FIG. 5.
Figure 7:
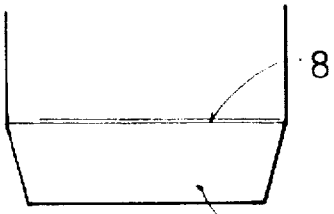

The cardboard tube 2 is a tube that can be flattened, as shown schematically in FIG. 4, made from a normal flat sheet, by making creases along its edges 3, folding and gluing on one side.

At the two ends of the tube 2, V-shaped notches 4 are made at the edges 3, forming pairs of opposite facing flaps 5, 6 that can bend around their respective lines of attachment 7,8 to the tube 2, to facilitate insertion of the frames 1.

Insertion of the frames on the tubes can take place manually or, preferably, automatically, by means of special equipment which is not described.

To allow correct positioning of the frames on the tubes 2, and to prevent them from accidentally slipping off, pre-cut tongues 10 are provided on three sides near the end of the tubes, so that they can be raised to form an obstacle preventing the frames from slipping off.

Figure 8:
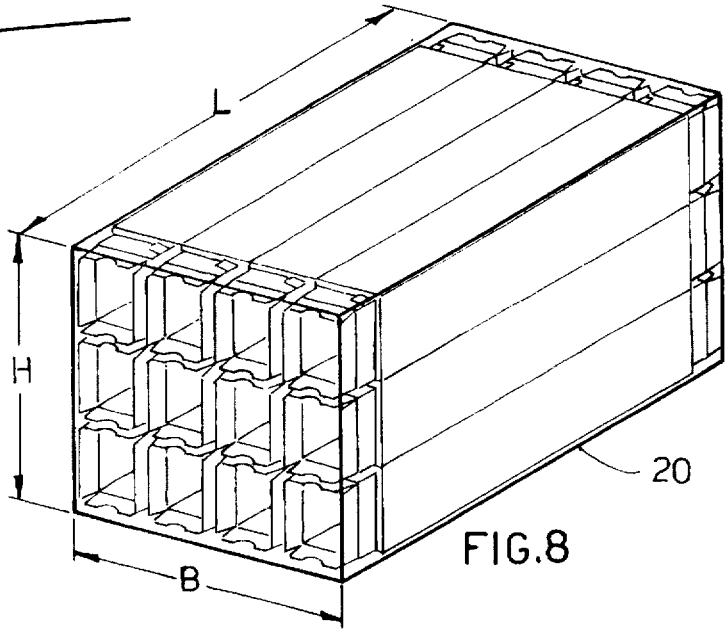
FIG. 8 is an axonometric view of a box containing a plurality of tubular cores, one of which is shown in FIG. 3 complete with frames.
Figure 9:
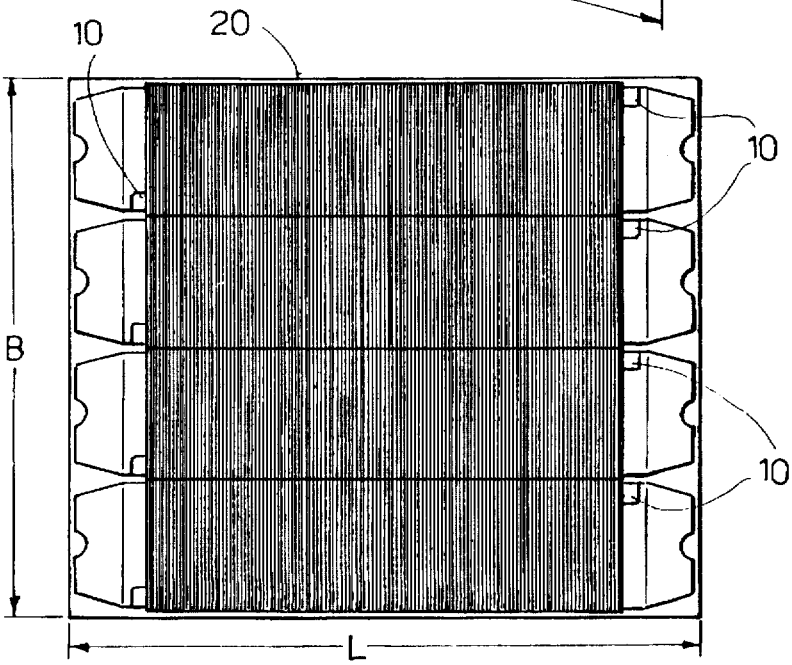
FIG. 9 is a plan view from above of the box in FIG. 8.
Figure 10:
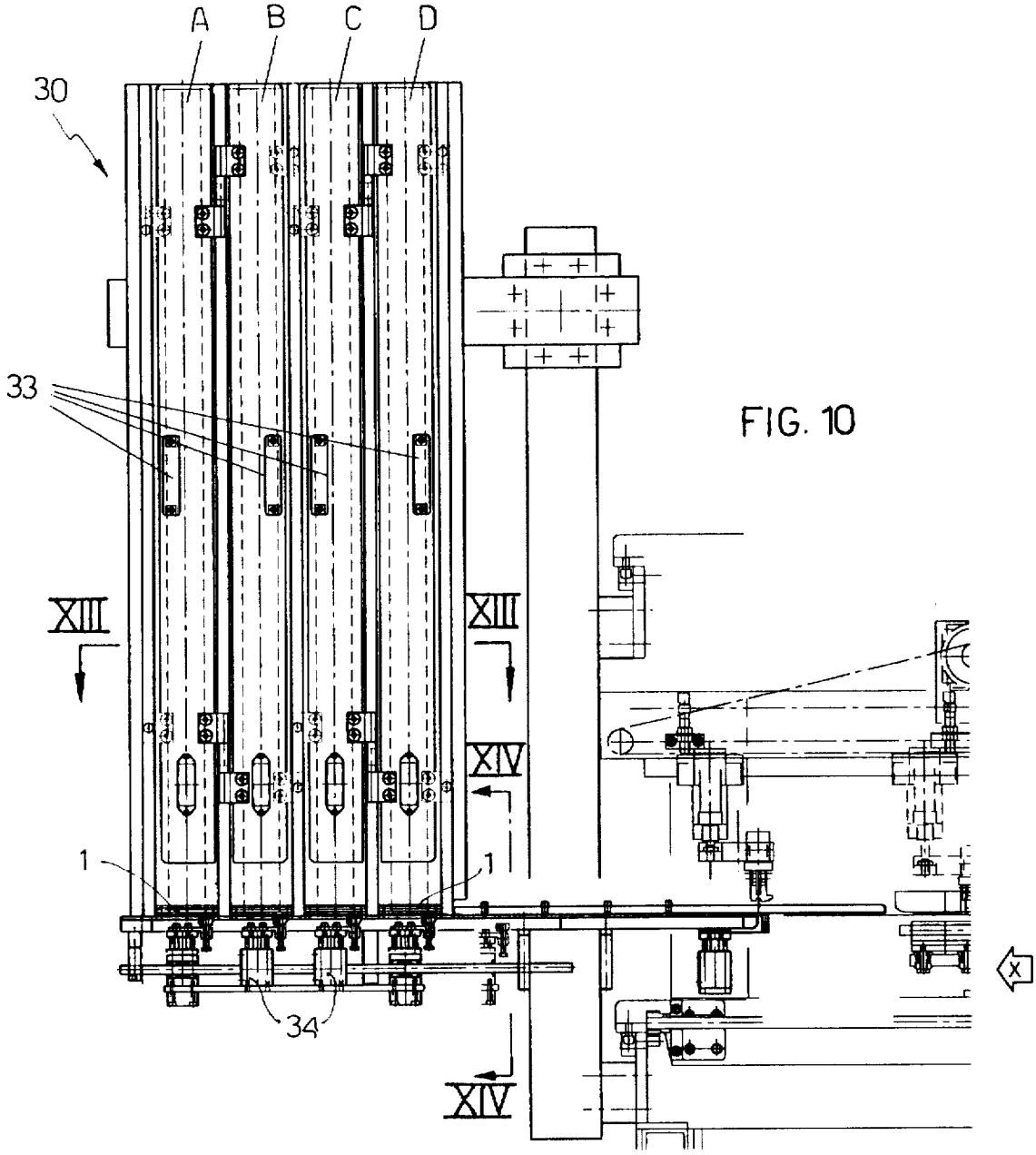
FIG. 10 is a side elevation of a frame loading and feeding unit of a packaging machine.
Figure 11:
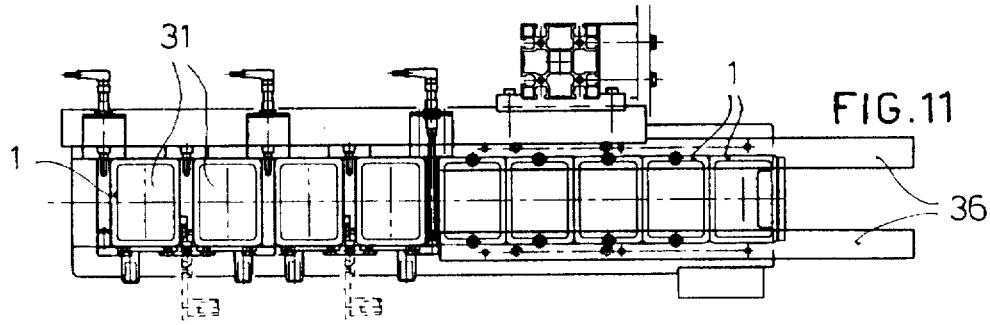
FIG. 11 is a plan view from above of the unit in FIG. 10.

On at least one flap 5, 6, and in particular on the pair of flaps 5 with reference to the appended figures, a bevel cut 11 is made to facilitate picking up of the tubes 2 complete with frames 1, when these are stored in rows one on top of the other in parallelepiped boxes 20, as shown in FIGS. 8 and 9.

In this way the accumulated frames take up an extremely small space and are all arranged in an orderly manner. In fact, in a container of moderate size, such as that illustrated in the figures, it is possible to insert 12 tubes with frames, from now on also called magazines, arranged in three rows of four magazines each, one on top of the other.

Again taking the example described above of frames measuring 8×10.5 cm, dimensions B and H, as indicated in the drawings, will be 32 cm and 31.5 cm, respectively. If the length L of the box 20, corresponding to the overall length of the tubes 2, is 70 cm, 60 cm of which are used to accommodate the frames 1, each magazine will contain 200 frames with a thickness of 3 mm, therefore each box 20 contains 2400 frames in a completely orderly arrangement.

The magazines made up by the tubes 2 complete with frames 1, indicated as a whole with reference number 25, are advantageously used to load the feeding unit of a packaging machine, shown in FIGS. 10 to 15, indicated as a whole with reference number 30.

The feeding unit of the packaging machine has a plurality of columns (4 with reference to the appended figures) indicated with the letters A, B, C, D, hollow on the inside, so as to form housings 31 for a respective pile of frames 1. Each hollow column has a door 32 at the front, that can be opened on a hinge using a special handle 33, in such a way as to allow the magazines 25 to be inserted from the front. Once a magazine is inserted with all its frames 1, the tubular cardboard core 2 is normally slid out from above, so that the inner friction exerted by said core does not prevent the frames from falling freely by gravity.

Of course the flames from more than one magazine 25 can be piled in each hollow column A, B, C, D.

Removal of the frames 1 takes place in the bottom part of each column by means of a respective slide 34 which, by means of special grippers 35, directs them in an orderly manner for use on guide rails 36.

Operation of the slides 34 with a reciprocating movement takes place, for example, by means of a pneumatic piston 37 (FIG. 15), and during this movement each frame 1 slides under the frames of subsequent columns, in such a way as to prevent discharge of the frames of said columns.

Sequential discharge of the frames 1 is thus obtained, working from column A towards column D. When the last column D begins to empty, the operator can proceed to load the preceding columns A, B, C with other magazines.

Each column A, B, C, D has its own sensor 40 which stops removal of the frames 1 when the pile of frames in said column reaches a pre-set minimum level, such as that indicated schematically in FIGS. 12 and 14. In this way there is a small reserve of frames during the loading stage.

The doors 32 are advantageously made of transparent material or with slits such as to make the inside visible so that the operator has an immediate view the situation and can intervene at the right moment.

The feed unit 30 thus makes it possible to accumulate a large number of frames 1 in an extremely small space, with emptying in sequence.

I claim:

1. A handling system for handling flat, hollow frames used with automatic packaging machines, comprising a tubular core having a shape corresponding to an inner profile of the frames, wherein said tubular core has end portions with notches at side edges defining opposite facing flaps, and a plurality of flat, hollow frames positioned on said tubular core in an orderly fashion.

2. A system according to claim 1, wherein said tubular core is made of folded cardboard.

3. A system according to claim 1, wherein a bevel cut is provided on at least one of said flaps.

4. A system according to claim 1, wherein said tubular core has opposite ends, and further comprising at least one liftable tongue positioned proximate each end of said tubular core, said liftable tongue to retain said frames on said tubular core.

5. A handling system for frames according to claim 1, further comprising boxes to contain a plurality of tubular cores carrying frames in rows, with said rows of tubular cores stacked one on top of the other.

6. A handling system for handling flat, hollow frames used with automatic packaging machines, comprising a tubular core having a shape corresponding to an inner profile of the frames, said frames being positionable on said tubular core in an orderly fashion, said tubular cores carrying frames comprise magazines, and a feed unit for a packaging machine, the feed unit including a plurality of hollow columns with respective inner housings for each containing a magazine of frames.

7. A system according to claim 6, wherein said columns of said feed unit have transparent doors at a front side for insertion of said magazines from the front side.

8. A system according to claim 6, further comprising means for removing said frames from the feed unit columns in sequence, starting from an end column and proceeding to an opposite end column.

9. A system according to claim 6, further comprising sensor means to monitor a quantity of frames in each column and to block removal of frames from a column when the quantity of frames reaches a pre-set minimum level.

10. A system according to claim 6, wherein said tubular core is made of folded cardboard.

11. A system according to claim 6, wherein said tubular core has end portions with notches at side edges defining opposite facing flaps.

12. A system according to claim 6, wherein a bevel cut is provided on at least one of said flaps.

13. A system according to claim 6, wherein said tubular core has opposite ends, and further comprising at least one liftable tongue formed as a flap cut into the core proximate each of said opposite ends, said liftable tongue to retain said frames on said tubular core.

14. A handling system for handling flat, hollow frames used with automatic packaging machines, comprising a tubular core having opposite ends and having a shape corresponding to an inner profile of the frames, wherein said frames are positionable on said tubular core in an orderly fashion, wherein said tubular core has at least one liftable tongue formed as a flap cut from the tubular core proximate each of said opposite ends, said liftable tongue to retain said frames on said tubular core.

15. A system according to claim 14, wherein said tubular core is made of folded cardboard.

16. A system according to claim 14, wherein said tubular core has end portions with notches at side edges defining opposite facing flaps.

17. A system according to claim 14, wherein a bevel cut is provided on at least one of said flaps.

* * * * *